US009375102B2

(12) United States Patent
Troyner et al.

(10) Patent No.: US 9,375,102 B2
(45) Date of Patent: Jun. 28, 2016

(54) PORTION OF SHELF AND SUPPORT FOR SHELVING UNIT

(75) Inventors: Anthony J. Troyner, Shorewood, IL (US); David J. Wojtowicz, Orland Park, IL (US); Thomas St. Germain, Bridgeview, IL (US); Antonio Luis Escalante, Chicago, IL (US)

(73) Assignee: Edsal Manufacturing Company, Inc., Chicago, IL (US)

( * ) Notice: Subject to any disclaimer, the term of this patent is extended or adjusted under 35 U.S.C. 154(b) by 43 days.

(21) Appl. No.: 12/829,726

(22) Filed: Jul. 2, 2010

(65) Prior Publication Data

US 2012/0000871 A1 Jan. 5, 2012

(51) Int. Cl.

| | |
|---|---|
| ***A47B 47/02*** | (2006.01) |
| ***A47F 5/01*** | (2006.01) |
| ***A47B 57/40*** | (2006.01) |
| ***A47B 96/02*** | (2006.01) |

(52) U.S. Cl.

CPC ..... *A47F 5/01* (2013.01); *A47B 47/021* (2013.01); *A47B 57/402* (2013.01); *A47B 96/02* (2013.01)

(58) Field of Classification Search

CPC .. A47B 47/021; A47B 47/027; A47B 47/028; A47B 57/50; A47B 57/402; A47B 57/22; A47B 57/487; A47B 57/40; A47B 57/425; A47B 57/58; A47B 57/00; A47B 57/16; A47B 96/1441; A47B 96/06; A47B 96/00; A47B 96/02; A47F 5/01; A47F 5/13; A47F 5/101; A47F 5/132; A47F 5/14

USPC ..... 211/134, 182, 183, 189, 187, 186, 191, 211/192, 190, 193

See application file for complete search history.

(56) References Cited

U.S. PATENT DOCUMENTS

| | | | | | |
|---|---|---|---|---|---|
| 2,815,130 | A | * | 12/1957 | Franks | 211/191 |
| 2,918,176 | A | * | 12/1959 | Bell et al. | 211/191 |
| 2,925,920 | A | * | 2/1960 | Skubic | 108/107 |
| 3,042,221 | A | * | 7/1962 | Rasmussen | 211/183 |
| 3,048,245 | A | * | 8/1962 | Shewell | 403/190 |
| 3,266,635 | A | * | 8/1966 | McConnell | 211/191 |
| 3,285,428 | A | * | 11/1966 | Scheck | 211/191 |
| 3,297,374 | A | * | 1/1967 | Radek | 312/108 |
| 3,463,325 | A | * | 8/1969 | Rogers et al. | 211/191 |
| 3,587,483 | A | * | 6/1971 | Konstant | 108/157.13 |
| 3,695,456 | A | * | 10/1972 | Lewis | 211/191 |
| 3,846,944 | A | * | 11/1974 | Lambert | 52/236.3 |
| 4,048,059 | A | * | 9/1977 | Evans | 108/155 |
| 4,078,664 | A | * | 3/1978 | McConnell | 211/189 |
| 4,342,397 | A | * | 8/1982 | Halstrick | 211/191 |
| 4,549,665 | A | * | 10/1985 | Smitley | 211/191 |
| 4,955,490 | A | * | 9/1990 | Schafer | 211/187 |
| 5,011,031 | A | * | 4/1991 | Konstant | 211/191 |
| 5,012,938 | A | * | 5/1991 | King | 211/191 |
| 5,310,066 | A | * | 5/1994 | Konstant | 211/193 |
| 5,628,415 | A | * | 5/1997 | Mulholland | 211/189 |
| 5,921,412 | A | * | 7/1999 | Merl | 211/90.03 |
| 6,105,798 | A | * | 8/2000 | Gruber et al. | 211/151 |
| 6,173,846 | B1 | * | 1/2001 | Anderson | 211/183 |

(Continued)

*Primary Examiner* — Patrick Hawn

(74) *Attorney, Agent, or Firm* — Wood, Herron & Evans, LLP

(57) ABSTRACT

A shelving unit includes formed front and rear beams providing shelf supporting and lower flanges, respectively. A C-shaped tie bar extends centrally between respective front and rear beams and is captured between the beam flanges with tie bar ends engaging the beams providing loaded shelf support and resisting loaded beam twisting.

8 Claims, 6 Drawing Sheets

(56) References Cited

U.S. PATENT DOCUMENTS

| | | | | |
|---|---|---|---|---|
| 6,739,463 | B2 * | 5/2004 | Wishart et al. | 211/189 |
| D545,092 | S * | 6/2007 | Knorring et al. | D6/510 |
| 7,614,511 | B2 * | 11/2009 | Konstant | 211/189 |
| 7,891,507 | B2 * | 2/2011 | Shetler | 211/135 |
| D637,427 | S * | 5/2011 | Troyner et al. | D6/511 |
| 8,016,141 | B2 * | 9/2011 | Konstant | 211/189 |
| 2003/0155319 | A1 * | 8/2003 | Wishart et al. | 211/189 |
| 2006/0163185 | A1 * | 7/2006 | Konstant | 211/189 |
| 2010/0181274 | A1 * | 7/2010 | Vargo et al. | 211/187 |

* cited by examiner

PORTION OF SHELF AND SUPPORT FOR SHELVING UNIT

FIELD OF THE INVENTION

This invention relates to shelving and more particularly to a shelving unit offering improved structural and load support.

BACKGROUND OF THE INVENTION

It is known to provide shelving having vertical corner columns, cross-beams and shelves supported by the beams in a variety of configurations. Structural integrity and load capacity are significant factors in the unit design. The load stresses caused by overloading or asymmetric loading can twist or sag shelving components.

Accordingly, it is desired to provide a shelving unit having improved structural configuration and improved resistance to deformation due to loading.

It is another objection of the invention to provide improved shelf support beams in combination with structural support elements.

It is also an objective of this invention to provide an improved shelving unit which can be shipped in a flat disassembled state and easily erected to provide a structurally sound and improved shelving unit.

SUMMARY OF THE INVENTION

To these ends, a preferred embodiment of the invention includes a four-column shelving unit having unique front and rear shelf-support beams respectively therebetween and a cooperating tie bar having ends fitting into the beams at positions intermediate the beam ends and defining upper shelf-supporting flanges extending perpendicular to the front and rear beams. The tie bar is preferably a formed channel having horizontally-extended, shelf-supporting flanges along its upper edges. The front and rear beams are formed to define an upper shelf supporting flange and a lower flange which cooperate to capture the ends of a tie bar disposed therebetween.

This combination of preferred elements produces a number of unique advantages. The tie bar provides direct structural support for the shelf medium. Extended between front and rear beams, the tie bar configuration maintains the central dimension which is spanned by shelf capacity loads. The tie bar prevents twisting of the front and rear beams otherwise due to excessive loading. The tie bar provides an additional safety factor in the event of uneven loading by an end user.

Use of such beam and tie bar in combination provides significant structural and support features over prior known shelving units with little additional cost.

This shelving unit can easily be provided in disassembled flat format, and is easy to erect at the point of display or use as will be described.

These and other objectives and advantages will be readily understood from the following written description of the drawings in which:

DETAILED DESCRIPTION OF THE INVENTION

It will be appreciated that the invention also provides an aesthetic appearance apart and differentiated from functional aspects of the claimed structure. A related design application is filed on even date herewith and is granted U.S. Ser. No. 29/365,087.

Figure 1:
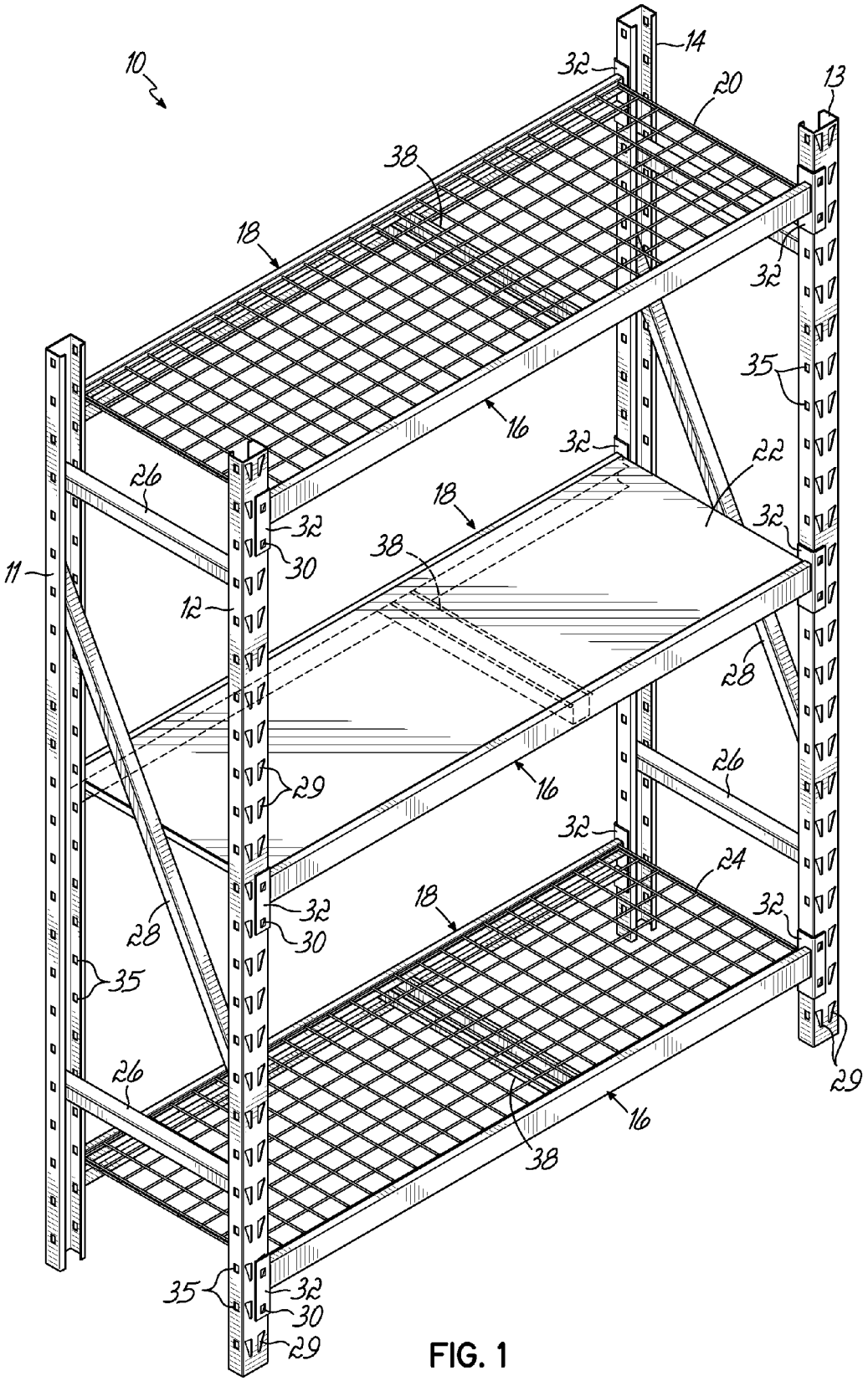
FIG. 1 is an isometric view of a shelving unit according to a preferred embodiment of the invention.

Turning now to the drawings, a shelving unit 10 according to the invention is illustrated in FIG. 1. Unit 10 includes four upright or vertically-oriented corner support columns 11, 12, 13, 14, horizontally-oriented front and rear shelf-support beams 16, 18 in multiple sets of two at different elevations as shown, and a variety of horizontally-oriented shelves 20, 22, 24.

Shelves 20, 22, 24 may be of any suitable medium. For example, shelves 20 and 24 comprise wire shelves including a plurality of woven or cross-set wires making up a shelf. Shelf 22, on the other hand, may be solid, laminated, honeycombed or other configurations of one or more suitable materials such as wood, particle board or other compositions.

The columns 11-14 are provided preferably in two joined sets, columns 11, 12 forming one side set and columns 13, 14, another side set. Each column set has a plurality of horizontal, welded-in braces 26, 27 and at least one inclined, welded-in brace 28. The columns 11, 12, and 13, 14, together with their respective braces 26-28 comprise side supports of the shelving unit 10.

The columns 11-14 are preferably slotted, as at 29, to accommodate tabs 30, extending from mounting brackets 32 supported ends of the respective front and rear beams 16, 18 as will be described. The similar slots 29 in columns 11 and 14 do not appear in the FIGS. due to the column orientation but are nevertheless used in the mounting of rear beams 18 on the same way as front beams 16.

Each of the front and rear beams 16, 18 have an L-shaped or angular mounting bracket 32 mounted or welded at the ends of the respective beams 16, 18. Each bracket 32 has two sides 33, 34 at 90 degrees to each other. Side 33 is essentially parallel to the face of the columns 11-14 having the slots 29, while side 34 is generally perpendicular thereto. Tabs 30 are typically provided in the side 33, however, may also be provided in side 34 for cooperation with slots 35 in the sides of columns 11-14 as shown. Sides 34 of the brackets 32 are secured to the end of a beam 16, 18 as by welding.

Figure 3A:
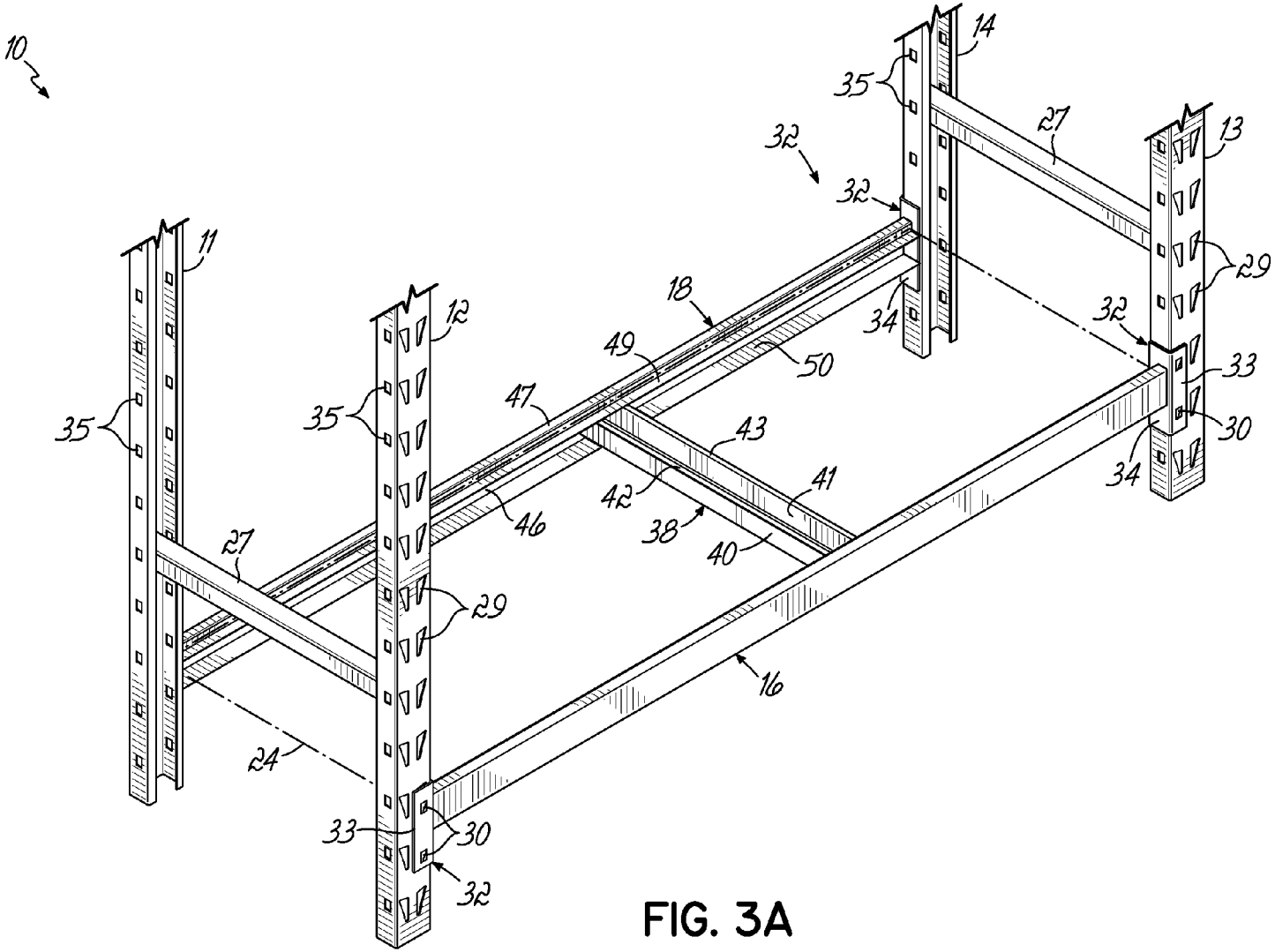
FIG. 3A is a partial isometric view of a lower portion of the invention of FIGS. 1 and 2 (with shelf removed for clarity)
Figure 3D:
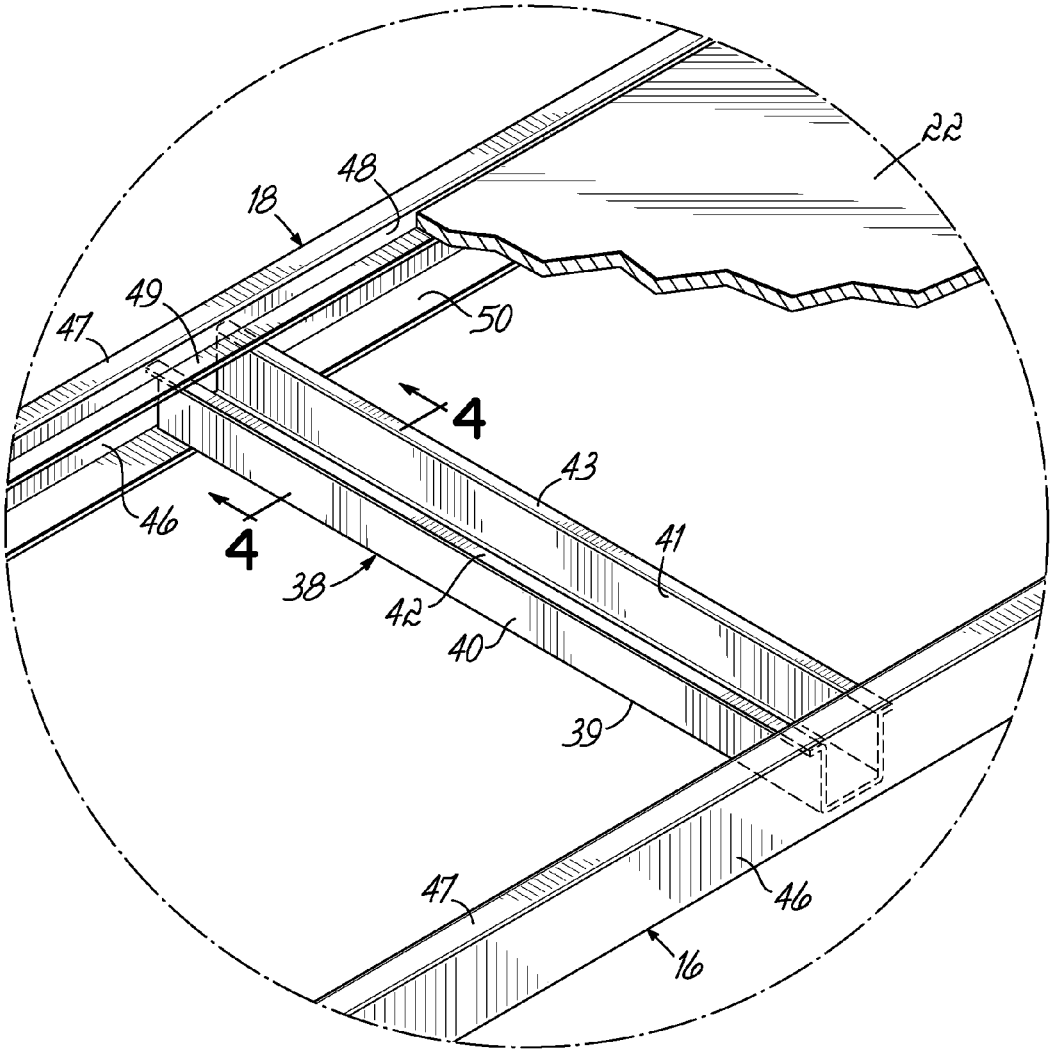
FIG. 3D is a view similar to FIG. 3C but showing the tie bar in place and a shelf portion.
Figure 4:
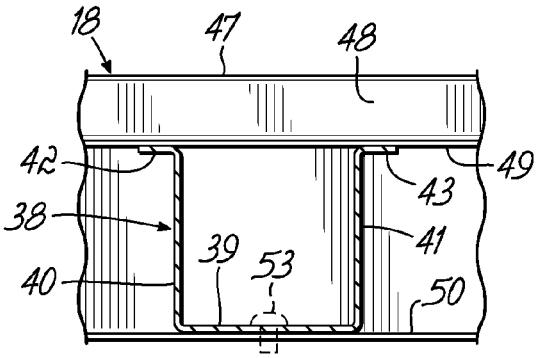
FIG. 4 is a cross-sectional view taken along lines 4-4 of FIG. 3D, but also showing a portion of a shelf on the beam.

A tie bar 38 is disposed across the assembled shelf unit 10, fitted into or captured by front and rear beams 16, 18 as noted below. Tie bar 38 is preferably in a C-shaped, channel-like, configuration having a bight 39, upstanding sides 40, 41 and shelf-support flanges 42, 43 extending along upper edges of sides 40, 41 and generally lying in a horizontal orientation (see FIGS. 3D and 4).

Each beam 16, 18 is a formed beam, preferably of metal. Each beam has a vertical face 46, an upper surface 47, a short inward face 48 and a shelf-supporting flange 49. Each beam 16, 18 has a lower flange 50, parallel to flange 49. As clearly shown in the original FIGS. 2, 3A, 3B and more specifically in original FIGS. 3C, 3D and 4, upper surface 47 and flange 49 extend away from respective beam faces 48, 46 (FIG. 3D) in the same parallel direction with surface 47 above flange 49. The view in FIG. 4 supports this orientation, with shelf 22 disposed between the surface 47 and flange 49.

Figure 2:
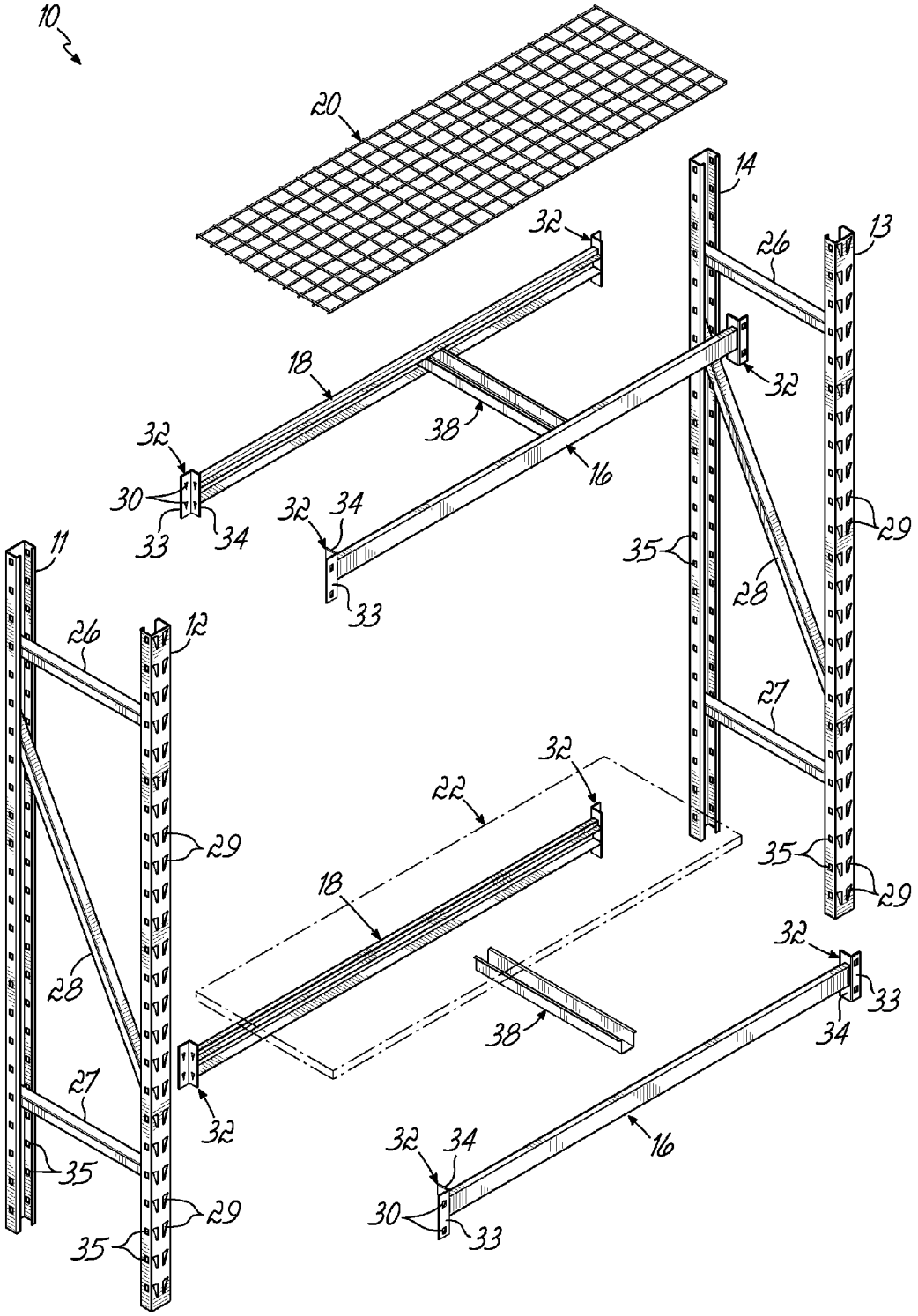
FIG. 2 is an exploded view of a portion of the invention of FIG. 1 and illustrates the separate components which can be laid together flat format for shipping.

As noted, shelf unit 10 can be shipped in flat, disassembled form with the components shown in FIG. 2, the side structures 11, 12 and 13, 14 with respective braces 26-28 being pre-assembled, but with shelves 20, 22, 24 and beams 16, 18 and tie bars 38 unassembled for flat packaging together.

At the point of use, the components are unpacked and assembled. The side structures principally formed of column sets 11, 12 and 13, 14 are positioned and beams 16, 18 attached thereto by means of brackets 32 and then tabs 30 cooperating with slots 29, 35.

Figure 3B:
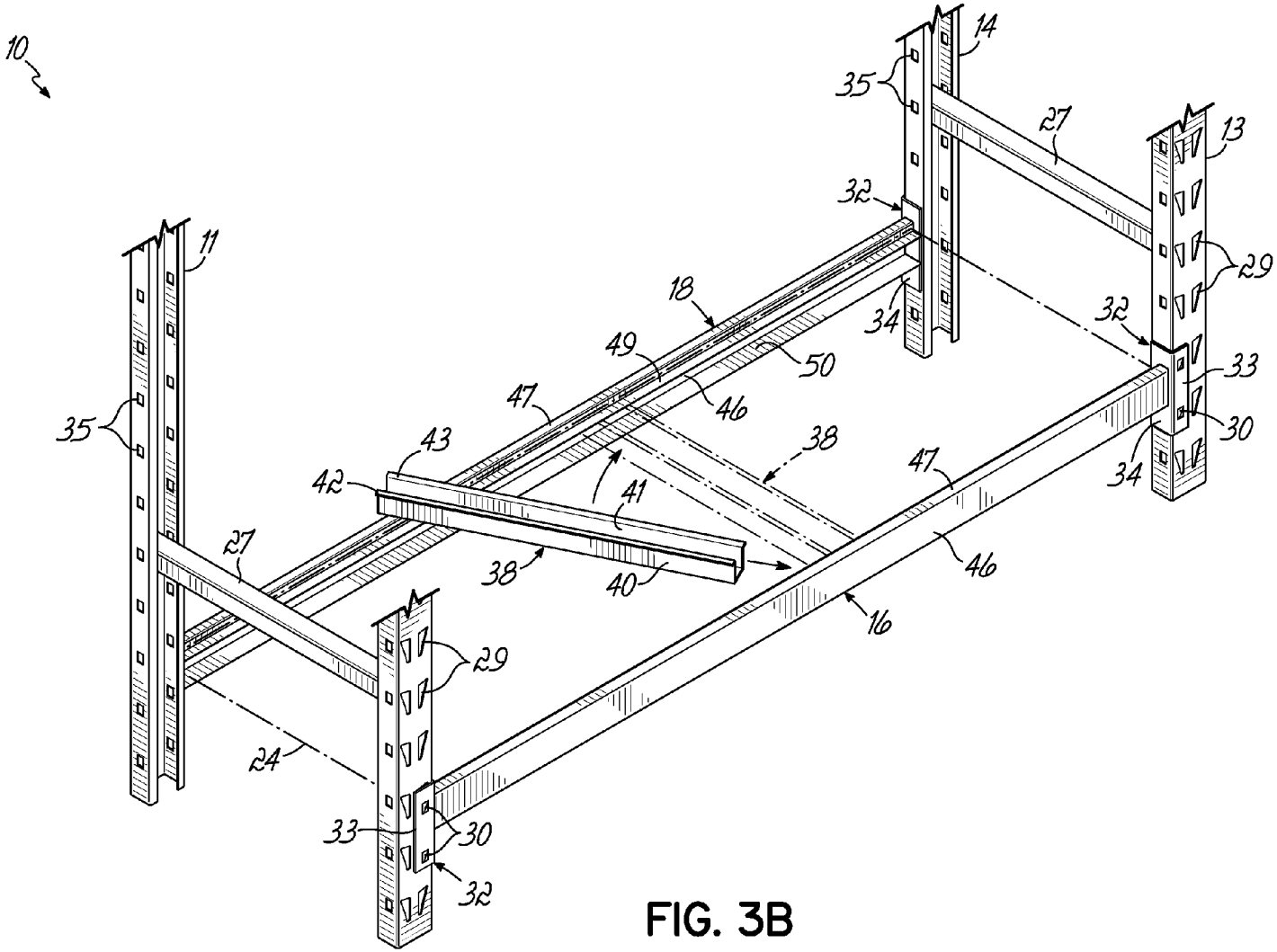
FIG. 3B is a view similar to FIG. 3A but illustrating insertion of the tie bar into place between front and rear shelf-supporting beams.
Figure 3C:
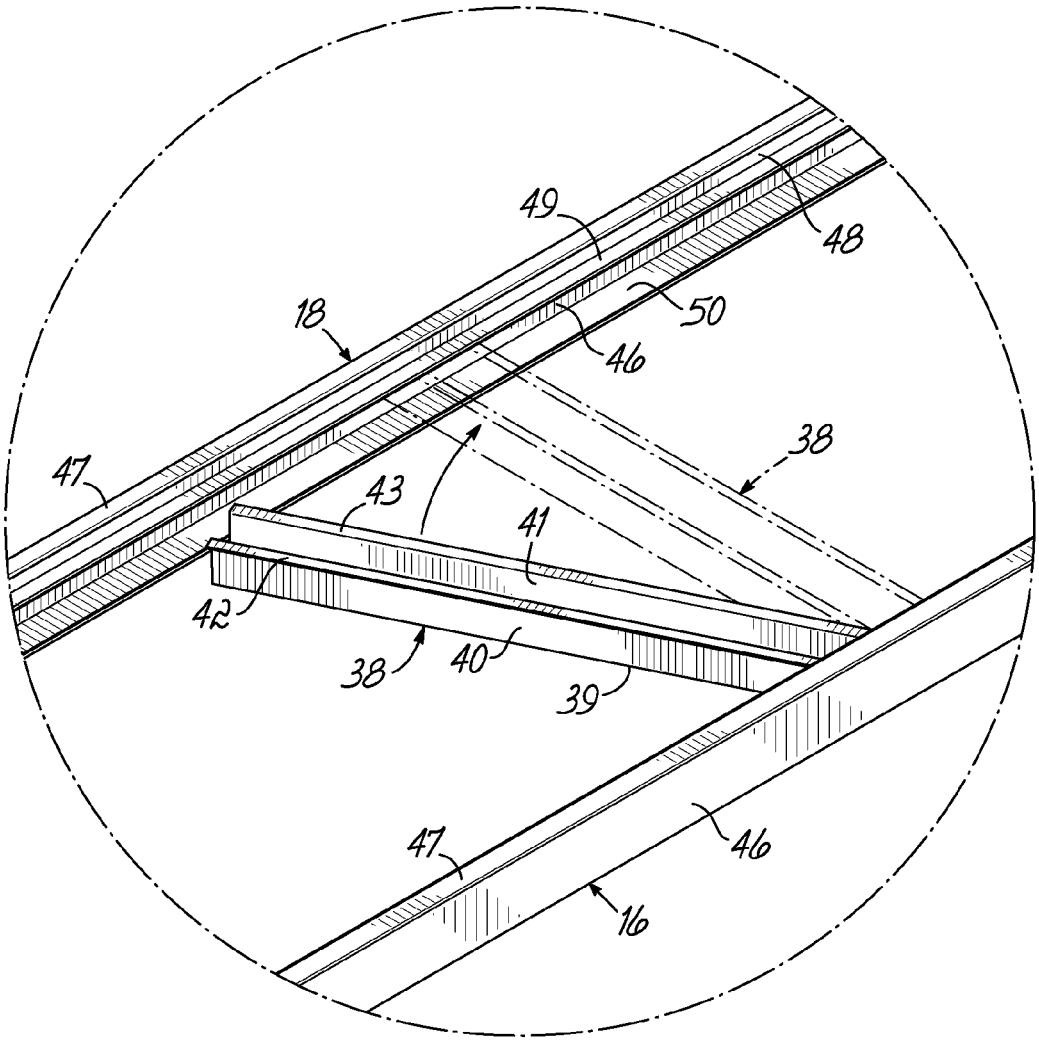
FIG. 3C is an isolated view of the tie bar and beam portion of FIG. 3B.

As then illustrated in FIGS. 3B and 3C, the tie bars 38 are positioned and swung into place between beams 16, 18 as shown. The respective ends of tie bar 38 interfit with or are captured by respective beams 16, 18 as follows. The bight portion 39 of the tie bar engages lower flanges 50 of the beams. The flanges 42, 43 of the tie bar 38 engage the underside of the shelf-support flanges 49 of the respective beams. In this fashion, the tie bar ends preferably engage the inner side of vertical face 46 of each beam. A very slight outward "bowing" of beams 16, 18 will accommodate the rotation of tie bars 38 into position. The tie bar 38 is thus captured in the respective beams 16, 18.

The ends of the tie bar 38 thus engage the beams 16, 18 in a position to resist any twisting of the beams 16, 18, while the engagement of the tie bar ends between the flanges 49, 50 of the beams adds additional structural rigidity to the interconnection of the beams 16, 18 and bars 38. A screw, rivet or other fastener 53 (FIG. 4) may be inserted through one or both ends of tie bar 38 into beam flanges 50 to further secure the bar 38 to the beams 16, 18.

In this regard, it will be appreciated that the height of the tie bar between the bottom surface of the bight portion 39 and the upper surfaces of flanges 42, 43 is approximately equal to the distance between the facing surfaces of parallel flanges 49, 50.

Accordingly, the invention provides significant and unique advantages in a shelving unit. It will be appreciated that if a shelf is asymmetrically or overloaded, the extra support provided by tie bar 38 directly supporting the shelf via contact of flanges 42, 43 prevents shelf sagging. The direct support of a shelf by direct engagement with tie bar 38 provides structural integrity.

Moreover, the engagement of the ends of tie bar 38 with beams 16, 18 prevents their twisting under heavy loads as might otherwise occur due to load torque. The unique cooperation of the ends of the tie bars 38 within the beams 16, 18 and the flanges 49, 50 thereof coordinates significant and unique structural rigidity providing load support twist resistance and additional safety factors in the event of uneven loading by an end user. Securement of the tie bar 38 ends to beams 16, 18 also maintains the center dimensions between the beams, adding to the integrity and stability of the shelving unit 10.

These and other modifications and advantages of the invention will be readily appreciated by the foregoing to those of ordinary skill in the art without departing from the scope of the invention and applicant intends to be bound only by the claims appended hereto.

What is claimed is:

1. A shelving unit comprising:

a plurality of corner columns front and rear shelf supporting beams;

each beam connected at respective ends thereof to respective corner column;

each beam including a first vertical component in a single vertical plane, and having two sides, an upper surface extending from one of said sides; a second vertical component extending downwardly away from said upper surface; said first and second vertical components being spaced apart and parallel; a shelf supporting flange extending solely in a single horizontal plane from a lower edge of said second vertical component for supporting a shelf beneath said upper surface lower than said upper surface, and a lower flange, spaced from, parallel and beneath said shelf supporting flange and said upper surface;

said upper surface, and said lower flange extending in separate horizontal planes and in parallel directions away from the same one of said sides of said first vertical component of said beam, said upper surface oriented at a level above said shelf supporting flange;

said shelving unit further comprising a tie bar having two respective ends;

each end of said tie bar engaging and captured between said shelf supporting flange and said lower flange of a front and a rear supporting beam respectively;

said tie bar providing resistance to twisting of said beams in which it is captured due to uneven shelf loading.

2. A shelving unit as in claim 1 wherein said tie bar comprises a channel including two upstanding sides and a flange extending along an upper edge of each side, each said flange engaging an underside of said shelf support flange beneath and spaced from a beam upper surface.

3. A shelving unit as in claim 2 further including a shelf support surface on the shelf support flange of each beam and a shelf support surface on said tie bar flanges intermediate respective ends of said tie bar.

4. A shelving unit as in claim 3 wherein said tie bar is fastened to said lower flange of each beam.

5. A shelving unit as in claim 3 wherein said one side of said first vertical component of each said beam comprises an inner side disposed between said shelf support flange and said lower flange and wherein a respective end of said tie bar engages a respective said inner side of each said beam.

6. A shelving unit as in claim 2 wherein said tie bar has a predetermined height between a lower portion of a bight member thereof and a shelf support surface defined by a shelf-supporting flange thereof, said height approximately equal to a distance between facing surfaces of said shelf support flange of said beams and the lower flange of said beams.

7. A shelving unit comprising:

a plurality of columns;

front and rear beams;

each said beam connected to respective ones of said corner columns;

each said beam having a first beam face component in a single vertical plane and further said beams comprising an upper flange defining an upper surface; a shelf supporting flange in a single horizontal plane beneath and spaced from said upper flange; and a lower flange spaced away from said shelf supporting flange and said upper flange;

each flange extending in parallel directions away from a same side of said beam in single horizontal planes parallel to the direction of extension of each other flange;

a second beam face parallel and spaced from said first beam face;

said shelf support supporting flange extending from an edge of said second beam face;

a shelf disposed on said shelf supporting flange of respective front and rear beams;

a tie bar having two ends, each end respectively captured between an underside of said shelf supporting flange of each beam and an upper side of said lower flange of each beam;

said tie bar ends respectively engaging at least said one side of one of said beams between said shelf supporting flange and said lower flange;

said tie bar resisting twisting of said beams in which it is captured;

said tie bar providing integrity and stability to said shelving unit.

8. A shelving unit comprising:

a plurality of corner columns front and rear shelf supporting beams;

each beam having a bracket secured to each end of said beam, each said bracket having a side and tabs therein for interconnecting to said columns, with said beam being connected at respective ends thereof to respective corner column;

each beam including a first vertical component in a single vertical plane, and having two sides, an upper surface, a second vertical component, a shelf supporting flange extending solely in a single horizontal plane from an edge of said second vertical component for supporting a shelf beneath said upper surface lower than said upper surface, and a lower flange spaced from, parallel and beneath said shelf supporting flange and said upper surface;

said upper surface, said shelf supporting flange and said lower flange extending in separate horizontal planes and in parallel directions away from a single one of said sides of said first and second vertical components of said beam, respectively;

said upper surface oriented at a level above said shelf supporting flange;

said shelving unit further comprising a tie bar having two respective ends;

each end of said tie bar engaging and captured between said shelf supporting flange and said lower flange of a front and a rear supporting beam respectively;

said tie bar providing resistance to twisting of said beams in which it is captured due to uneven shelf loading.

* * * * *